United States Patent [19]

Shteyngarts et al.

[11] Patent Number: 4,726,457

[45] Date of Patent: Feb. 23, 1988

[54] COIN MECHANISM

[75] Inventors: Gregory Shteyngarts, South Euclid; Joseph Feldman, Lyndhurst, both of Ohio

[73] Assignees: Larry S. Frankel, University Hts., Ohio; Martin S. Frankel, Los Angeles, Calif.

[21] Appl. No.: 27,078

[22] Filed: Mar. 17, 1987

Related U.S. Application Data

[63] Continuation of Ser. No. 735,157, May 17, 1985, abandoned.

[51] Int. Cl.[4] ..... G07F 5/02

[52] U.S. Cl. ..... 194/290; 194/337; 194/346

[58] Field of Search ..... 194/290, 337, 345, 346

[56] References Cited

U.S. PATENT DOCUMENTS 1,483,777 2/1924 Callahan ..... 194/346 X 1,926,232 9/1933 Gilmore ..... 194/346 X

*Primary Examiner*—F. J. Bartuska

*Attorney, Agent, or Firm*—D. Peter Hochberg; Mark M. Kusner; Walter C. Danison, Jr.

[57] ABSTRACT

A coin mechanism for vending machines comprising a coin receptacle, a detector for unlocking a dispensing mechanism only when a coin of the proper size is received in the receptacle, and a coin retaining device for retaining coins deposited in the mechanism only when a selected product has been properly dispensed from the machine. The detector includes a wall defining part of a coin slot, a window in the wall, a coin holding lever for holding coins across the window only when such coins are of the proper denomination, and a detector arm for entering the window when it is open to prevent the actuation of the product dispensing mechanism and for enabling the actuation of the dispensing mechanism when the window is closed by a coin.

13 Claims, 1 Drawing Figure

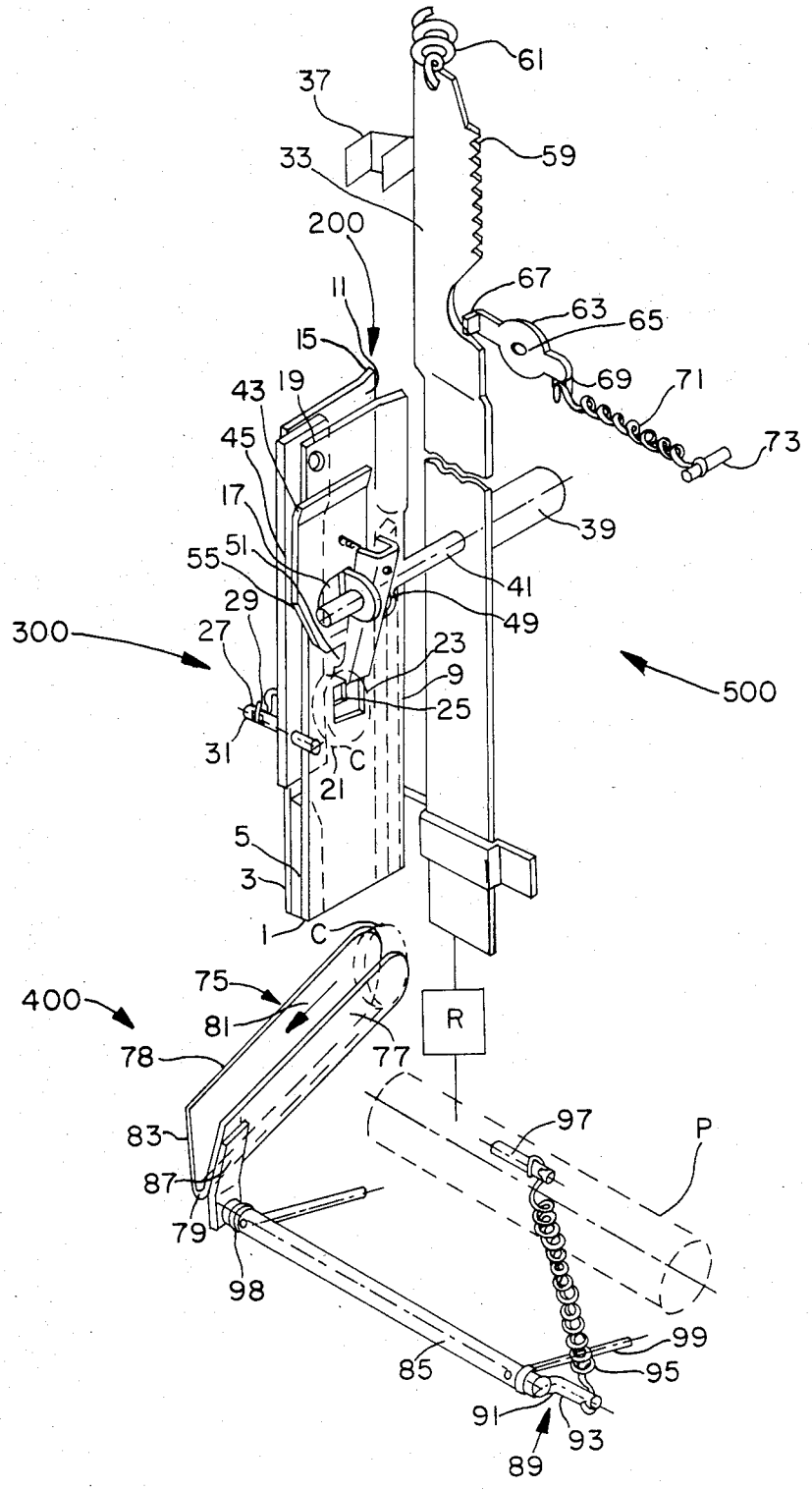
61
37
59
33
200
67
11
63
65
15
69
71
43
19
73
45
39
17
51
41
55
49
29
300
27
23
9
500
25
31
C
21
5
3
1
C
75
400
81
R
78
77
97
P
83
87
79
98
99
85
95
91
93
89

COIN MECHANISM

This is a continuation of co-pending application Ser. No. 735,157 filed on May 17, 1985 now abandoned.

BACKGROUND OF THE INVENTION

This invention relates to coin mechanisms, and in particular to coin mechanisms for controlling the dispensing of products from vending machines.

Vending machines are prolific, being located in many places where people congregate such as stores, entertainment facilities, industrial work places, institutions of all types, side walks, gasoline stations, etc. The rest rooms in these facilities often include vending machines for dispensing a variety of products such as sanitary napkins. Despite the vast number of vending machines and the extensive use to which they are continuously put, they—or more specifically their coin mechanisms—suffer from some serious deficiencies. One such deficiency relates to the inability of many coin mechanisms to reject coins of the wrong denomination for purchasing a product in a vending machine. Many coin mechanisms which for example are intended to accept a quarter (a U.S. 25 cent coin) to trigger the dispensing of a product, will accept coins of another denomination, for example a dime (a U.S. 10 cent coin) without dispensing a product. Another deficiency of many known coin mechanisms for vending machines relates to their retention of deposited coins when a selected product is for some reason not dispensed from the machine, such as because of an obstruction in the dispensing path or an orientation of the product which precludes its release from the machine. A third shortcoming which is common to known vending machine coin mechanisms is the inherent complexity of such mechanism, creating a high potential for malfunction and further resulting in relatively high costs of manufacturing and assembling component parts, subassemblies and the final assembly of the coin mechanism. The loss of coins in vending machines frequently leads to frustration and anger of persons depositing coins, which frustration and anger is occasionally vented on the vending machine itself, resulting in the defacing or other damage to the machine. Such frustration may as well result in resentment towards the owner of the vending machine and towards the proprietor of the facility in which the machine is located.

SUMMARY OF THE INVENTION

It is an object of the invention to provide an improved coin mechanism for vending machines.

Another, more particular object is the provision of an improved coin mechanism for vending machines which retains coins of a predetermined denomination and which does not retain other coins.

A further object is the provision of such coin mechanisms which reject deposited coins when selected products are not dispensed from the vending machine.

It is yet another object of the invention to provide an improved vending machine coin mechanism which is of simple and rugged construction, and which is not susceptible of malfunction or tampering.

A general object of the invention is the provision of an improved coin mechanism for receiving deposited coins, tokens or the like, and which is economical to manufacture and operate, and effective and efficient to use. Other objects will be apparent from the description to follow and from the appended claims.

These objects are achieved according to the preferred embodiment of the invention by the provision of a coin mechanism for controlling the dispensing of products from a vending machine, the mechanism including a coin receptacle, a detector device for unlocking a dispensing mechanism only when a coin of the proper size is received in the receptacle, and a coin retaining device for retaining coins deposited in the mechanism only when a selected product has been properly dispensed from the machine. The detector device includes a wall defining part of a coin slot, a window in the wall, a coin holding lever configured and arranged to hold deposited coins across the window only when such coins are of a predetermined size corresponding to the proper denomination of coins for purchasing the product in the vending machine, and a detector arm for entering the window when it is open to prevent the actuating of the product dispensing mechanism of the machine and for enabling the actuation of the dispensing mechanism when the window is closed by a coin.

BRIEF DESCRIPTION OF THE DRAWING

The drawing shows in perspective the preferred embodiment of a coin mechanism according to the invention.

DETAILED DESCRIPTION OF THE PREFERRED EMBODIMENT

The coin mechanism 100 according to the preferred embodiment of the invention as shown in the drawing includes a coin receptacle 200, a detector device 300, a coin retaining device 400 and an actuating device 500. Coin receptacle 200 includes a pair of opposing, parallel walls or plates 1 and 3 which are spaced apart by spacer bars 5 and 9 by a distance slightly greater than the thickness of the largest coin which mechanism 100 is expected to receive, to define a coin slot 11. A pair of inclined flanges 13, 15 at the upper end portions of respective plates 1, 3 are provided for guiding coins C into slot 11 from a coin insert opening (not shown). A dog 17 is pivotally mounted on an axle 19 for rotational movement between plates 1, 3. Dog 17 has parallel side edges, the lower portion of the inner edge being curved to define a shoulder 21 shaped to receive and retain only coins C of a predetermined size and, hence, denomination. Shoulder 21 is positioned below aligned windows 23, 25 in plates 1,3 by a distance such that coins C resting on shoulder 21 close windows 23, 25. Axle 19 is fixedly mounted in plates 1, 3 or in other structure (not shown). Drive means in the form of a cam follower or rod 27 parallel to axle 19 extends through dog 17 and serves as a stop to limit the counterclockwise rotation of the dog relative to plates 1, 3 as well as to effect the clockwise rotation of dog 17 as explained below. A coil spring 29 is connected at one end in an annular groove 31 in rod 27 and at its other end to plate 3 or other structure fixed relative to rod 27, for biasing dog 17 in the counterclockwise direction towards and between plates 1, 3.

Actuating device 500 includes carrier means in the form of a slide bar 33 mounted to move in a linear path with the aid of fixed guides 35 and 37 mounted on structure associated with the machine in which mechanism 100 is disposed. A handle 39 mounted on slide bar 33 is grasped by the user's hand to move bar 33 in its vertical, linear path. A shaft 41 coaxial with handle 39 extends from the opposite surface of slide bar 33. Engagement means in the form of a cam plate 43 has a forwardly folded tab 45 with a hole dimensioned to receive shaft 41 which extends therethrough to support cam plate 43. Sensing means including a sensing lever 47 is pivotally mounted on shaft 41, and is retained in place on the shaft by means of tab 45 and a lockwasher 49. Lever 47 terminates at its lower end in a nose 51, and nose 51 is dimensioned to enter windows 23 when rod 41 is the requisite distance from the window. A coil spring 53 mounted between cam plate 43 and lever 47 biases the lever in the clockwise direction. Cam plate 43 includes a cam surface 55 which is disposed vertically above rod 27.

Slide bar 33 is movable in the vertically downward position from the position shown in the drawing. A curved insert 57 is provided in the forward edge of slide bar 33, and a ratchet 59 is provided in the same forward edge which extends from the upper end of insert 57 to a short distance from the upper end of the slide bar. Slide bar 33 is biassed upwardly by means of a spring 61 interconnecting the slide bar and structure in the machine in which mechanism 100 is located. A pawl 63 is mounted on a pivot pin 65. Pawl 63 includes a rearwardly extending tongue 67 and a forwardly extending spring support member 69. A coil string 71 interconnects member 69 and a post 73 fixed relative to the machine in which mechanism 100 is located. Spring 71 biasses pawl 63 so that tongue 67 tends to extend rearwardly as shown in the drawing.

Coin retaining device 400 includes a coin chute 75 having opposing, outwardly flared side walls 77, 78 which extend upwardly from a bottom wall 79. Chute 75 is positioned beneath coin slot 11 and normally inclined downwardly towards the plane of drawing, for receiving coins C discharged from slot 11 which are gravity fed in the direction of arrow 81. A discharge port is disposed adjacent the forward position 83 of chute 75 for returning coins C to the person who deposited the coin when chute 75 is in the position shown, as explained in detail below.

A support member in the form of a shaft 85 generally perpendicular to the direction of movement of slide bar 33 and to chute 75, is rotatably mounted in the machine in which coin mechanism 100 is disposed. Chute 75 is fixed on shaft 85 by means of a tab 87 which is keyed to shaft 85 at one end and secured by means of a weldment or the like to sidewall 77 of chute 75. Chute 75 thus extends generally radially from shaft 85 and is rotatable therewith. An L-shaped lug 89 is attached to and extends from shaft 85, the lug including a first arm 91 extending radially from shaft 85 and a second arm 93 bent from arm 91 and extending beyond the end of and in the same direction as shaft 85. Return means in the form of a coil spring 95 is attached at one end to a fixed post 97 and at its opposite end to arm 93 for biassing shaft in the counterclockwise direction to the position shown in the drawing, with chute 75 positioned beneath slot 11.

Dispensed product response means in the form of a pair of parallel fingers 98 and 99, which are pieces of wire secured by means of weldments near the opposite ends of shaft 85, extend radially from shaft 75. Fingers 98 and 99 are disposed in the path of a product P when the product is discharged from the machine. The strength of spring 95 and the contact position of product P are chosen so that shaft 85 is maintained in the illustrated position under the influence of spring 95 with coin chute 75 disposed beneath slot 11 to discharge coins received from slot 11 out of the machine. However, when a product P lands on fingers 98, 99, shaft 85 rotates clockwise by virtue of the torque applied by product P to shaft 85 via fingers 98, 99 until spring 95 passes the axis of shaft 85, at which time chute 75 flips about 90° clockwise from the active position shown, to an inactive position to remove chute 75 from the discharge path of slot 11. Coins C leaving coin slot 11 no longer land in coin chute 75 so long as the chute is in its inactive position, but rather land in a coin box or the like.

The operation of device 100 is as follows. Initially, the respective components are in the positions shown in the FIGURE. A person desiring to purchase a product P from the machine in which the device is disposed deposits a coin C in an entrance port in the machine, and the coin is guided between flanges 13, 15 into coin slot 11. If the coin is of the proper denomination, it drops onto shoulder 21 of dog 17 and is seated across windows 23, 25. The user grasps handle 39 and moves slide bar 33 downwardly under the guidance of guides 35 and 37 against the bias of spring 61. During the downward movement of slide bar 33, tongue 67 of pawl 63 moves out of insert 57 and rides across ratchet 59. If the user releases handle 39 deliberately or inadvertently, tongue 67 engages one of the teeth of ratchet 59 and prevents spring 61 from returning slide bar 33 to its upward position.

As the user moves slide bar 33 downwardly, it carries rod 41, cam plate 43 and lever 47 with it. During this travel, nose 51 of lever 47 rides across coin C covering windows 23 and 25, and cam surface 55 of cam plate 43 engages rod 27. The continued travel of slide bar 33 rotates dog 17 clockwise against the bias of spring 29, releasing coin C from shoulder 21. At some time between the seating of the coin on shoulder 21 and the release of the coin upon the rotation of dog 17, slide bar 33 effects the release of product P from the storage facility of the machine. The release mechanism is shown schematically by the block R. Product P lands on fingers 98, 99 and rotates shaft 85 clockwise against the influence of spring 95. As shaft 85 rotates, it carries coin chute 75 along its clockwise path, and when arm 93 of lug 89 carries the lower end of spring 95 past center, i.e. past the plane containing the axis of shaft 85 and post 97, chute 75 and fingers 98, 99 flip to generally vertically downward positions. Coin C now drops unimpeded into the coin box and product P is dispensed from the machine.

The coin entrance to the machine or the size of the upper end of chute 11 are selected to prevent the insertion of coins of the wrong denomination as reflected by their large size. If coins C are too small, they will drop down slot 11 without seating on shoulder 21 and without blocking windows 23, 25. Such coins simply land in coin chute 75 for discharge from the machine. Should a person attempt to depress handle 39 to move slide bar 33 in an effort to obtain product P when windows 23, 25 are open (as where no coin is seated on shoulder 21 or a washer is seated there), nose 51 enters the windows upon the depression of handle 39 to block the further downward movement of slide bar 33. This occurs while tongue 67 is still located in insert 57 and before the tongue has engaged ratchet 59, so that spring 61 returns slide bar 33 to its initial upward position upon the release of handle 39.

In the event product P does not land on fingers 98, 99 either because the product was somehow jammed or otherwise blocked from reaching the fingers or because the supply of product P in the machine was exhausted, coin chute 11 remains in its active position as shown in the FIGURE. As the user depresses handle 39 to lower slide bar 33, cam surface 55 of cam plate 43 rotates dog 17 to release coin 7 of the proper size from shoulder 21 as discussed earlier. However, since coin chute 75 has remained in its active position, coin C simply drops from the lower end of slot 11 into chute 75, and proceeds in the direction of arrow 81 out of the machine. When the user releases handle 39, spring 61 returns slide bar 33 to its raised position with tongue 67 riding over the teeth of ratchet 59 until the tongue enters insert 57. As slide bar 33 moves to its raised position, it returns coin retaining device 400 to its inactive position.

It can be seen that the coin mechanism as described above fulfills the objects of the invention and is a highly effective device. This vending machine coin mechanism accepts only coins of the proper size and rejects all others. The mechanism only retains coins if the product sought to be purchased is actually dispensed from the machine. The mechanism in its preferred form is economical to make and use, and it is of simple yet rugged construction and capable of reliable performance.

The invention has been described in detail with particular reference to the preferred embodiment, but it should be understood that modifications and variations within the spirit and scope of the invention may occur to those skilled in the art to which the invention pertains.

We claim:

1. A coin mechanism for a vending machine, said coin mechanism receiving coins and effecting the dispensing of product from the machine purchased with the coins and comprising:

coin receptacle means comprised of parallel wall members defining opposed walls of a slot for receiving coins deposited into the machine;

a window through one of said wall members;

a holding lever pivotally mounted between said wall members having a surface defining a third wall of said slot, said lever being pivotally movable between a coin holding position for holding coins of proper size across said window and a coin releasing position for not holding coins of improper size;

a carrier movable along a linear path relative to said window between an inactive position and an active position for effecting discharge of product from the machine;

sensing means on said carrier for sensing the presence or absence of a coin at said window, said sensing means having a first condition reflective of the presence of a coin of improper size and a second condition reflective of a coin of proper size, said sensing means preventing movement of said carrier to said active position when in said first condition;

coin retaining means having a dispensing condition for receiving coins discharged by said receptacle means and for dispensing said received coins from the machine, and an enabling condition for enabling the retention of coins discharged by said receptacle means;

dispensing means for dispensing product from the machine in response to movement of said carrier to the active position; and an actuator for effecting dispensing of said product and the discharge of coins from said coin receptacle means, said actuator being fixedly connected to said carrier and said sensing means to effect movement of said carrier and sensing means therewith, said coin retaining means assuming the dispensing condition in response to said sensing means assuming its first condition and said coin retaining means assuming the enabling condition in response to said sensing means assuming its second condition, said holding lever moving to said coin release position when said coin retaining means assumes said enabling condition.

2. The invention according to claim 1 wherein said receptacle means comprises wall means defining a slot for receiving coins deposited in the machine.

3. The invention according to claim 1 and further including dispensed product response means operatively connected to said coin retaining means for placing said coin retaining means in the enabling condition in response to the dispensing of product from the machine.

4. The invention according to claim 3 and further including return means for urging said coin retaining means to the dispensing condition.

5. The invention according to claim 3 wherein said dispensed product response means includes finger means disposed in the discharge path of product being dispensed from the machine for moving said coin retaining means to the enabling condition in response to the contact of said finger means by the discharged product.

6. The invention according to claim 5 wherein said coin retaining means includes a chute mounted for movement between the dispensing condition for catching coins discharged from said coin receptacle means and the enabling condition for not catching said coins and a rotatable support member supporting said chute, and said dispensed product response means comprises a finger extending from said rotatable support member for rotating said support member to move said chute to the enabling condition in response to product striking said finger.

7. The invention according to claim 1 wherein said carrier means includes means for manually moving said carrier means from the inactive condition to the active position, and limiting means for preventing the return movement of said means to the inactive condition before said carrier means has moved from the inactive condition to the active condition.

8. The invention according to claim 7 wherein said limiting means comprises a pawl an ratchet.

9. The invention according to claim 1 wherein said holding lever includes drive means, and said carrier includes engagement means movable with said carrier, said engagement means engaging said drive means to move said holding lever to release a coin held by said holding lever as said carrier moves to the active condition.

10. The invention according to claim 9 wherein said drive means comprises a cam follower mounted on said holding lever, and said engagement means comprises a cam plate having a cam surface for engaging said cam follower.

11. The invention according to claim 9 wherein said holding legver includes means for biasing said holding lever toward said coin holding position.

12. The invention according to claim 1 wherein said sensing means comprises sensing lever means pivotally mounted on an axle movable with said carrier, said sensing lever means entering said window when said holding lever is not holding a coin across said window to prevent movement of said carrier to the active condition and said sensing lever means passing over said window when said holding lever is holding a coin across said window to enable movement of said carrier to the active condition.

13. The invention according to claim 12 and further including sensing lever biasing means for biasing said sensing lever in the direction for entering said window.

* * * * *